US008475235B2

(12) United States Patent
Kilgren et al.

(10) Patent No.: US 8,475,235 B2
(45) Date of Patent: Jul. 2, 2013

(54) GRINDING HOLDER IN A MACHINING DEVICE

(75) Inventors: Kåre Kilgren, Svartsjö (SE); Håkan Thysell, Söderköping (SE); Johan Sunesson, Linköping (SE)

(73) Assignee: HTC Sweden AB, Söderköping (SE)

( * ) Notice: Subject to any disclaimer, the term of this patent is extended or adjusted under 35 U.S.C. 154(b) by 677 days.

(21) Appl. No.: 12/596,628

(22) PCT Filed: Apr. 18, 2008

(86) PCT No.: PCT/SE2008/050446

§ 371 (c)(1),
(2), (4) Date: Feb. 4, 2010

(87) PCT Pub. No.: WO2008/130317

PCT Pub. Date: Oct. 30, 2008

(65) Prior Publication Data

US 2010/0144250 A1 Jun. 10, 2010

(30) Foreign Application Priority Data

Apr. 23, 2007 (EP) ..... 07106682

(51) Int. Cl.
*B24B 23/02* (2006.01)

(52) U.S. Cl.
USPC ..... 451/353; 451/350

(58) Field of Classification Search
USPC ..... 451/350, 353
See application file for complete search history.

(56) References Cited

U.S. PATENT DOCUMENTS

| | | | | |
|---|---|---|---|---|
| 5,416,943 | A * | 5/1995 | Weltikol et al. | 15/49.1 |
| 5,439,413 | A * | 8/1995 | Lagler | 451/353 |
| 5,746,645 | A * | 5/1998 | Beal et al. | 451/11 |
| 5,882,086 | A * | 3/1999 | Bremner et al. | 299/41.1 |
| 6,027,401 | A * | 2/2000 | Saito et al. | 451/398 |
| 6,231,432 | B1 * | 5/2001 | Peterson et al. | 451/350 |
| 6,287,181 | B1 * | 9/2001 | Dekok et al. | 451/353 |
| 6,869,344 | B2 * | 3/2005 | Miyahara et al. | 451/287 |
| 7,954,482 | B2 * | 6/2011 | Castonguay et al. | 125/13.01 |

FOREIGN PATENT DOCUMENTS

| | | | |
|---|---|---|---|
| EP | 0 650 691 | B1 | 6/1998 |
| EP | 1 321 233 | A1 | 11/2002 |
| EP | 1 306 167 | A1 | 5/2003 |
| GB | 2 413 264 | A | 4/2004 |
| SE | 528 858 | C2 | 2/2007 |
| WO | WO 94/08752 | | 4/1994 |
| WO | WO 2004/108352 | A2 | 12/2004 |

* cited by examiner

*Primary Examiner* — Maurina Rachuba
(74) *Attorney, Agent, or Firm* — Merchant & Gould P.C.

(57) ABSTRACT

The invention relates to a grinding holder (10) for connecting a rotary driven tool (20) to a device (30) for machining floor and road surfaces, comprising a first plate member (40) for detachable attachment of the tool (20), and a second plate member (50) for detachable attachment to the machining device (30).

27 Claims, 3 Drawing Sheets

GRINDING HOLDER IN A MACHINING DEVICE

This application is a National Stage Application of PCT/SE2008/050446, filed Apr. 18, 2008, which claims benefit of Serial No. 07106682.3, filed Apr. 23, 2007 in the EPO and which application(s) are incorporated herein by reference. To the extent appropriate, a claim of priority is made to each of the above disclosed applications.

TECHNICAL FIELD OF THE INVENTION

The present invention relates to a tool and tool holder for machining floors, more specifically a grinding holder that holds at least one such tool and tool holder during machining.

DESCRIPTION OF RELATED ART

Today, tools for machining stone or concrete floors or road surfaces, i.e. primarily grinding and polishing but also cutting, milling or crushing such surfaces and/or cleaning these surfaces by removing coatings on them with the object of producing plane, clean and/or smooth surfaces commonly use a machining appliance which carries one or more rotatably mounted plates that in turn carries one or more machining elements, e.g. in the form of discs that are smaller than the carrier plates and adapted to be rotated in relation to the carrier plates for machining the surface. This machining disc contacts the surface by means of different types of cutters/bits while performing a movement in a plane in parallel to the rotating carrier plates, so that a machining of the surface is produced, which resulting machined surface must be sufficiently plane.

In order to provide the machined surface with a sufficient flatness, the plates carrying the tool holder with the machining elements have to be held with a holder device, i.e. a grinding holder, that is sufficiently steady but, at the same time, gives a flexibility such that a desired ability to yield is provided when uneven surfaces are machined, i.e. the grinding holder provides a flexibility for the tool so that when it is moved over the uneven surface it yields and "follows" the uneven contour or structure of the surface being machined.

A prior art grinding holder 108 uses one or more flexible webs or cords (Polycord) similar to tyre cord being clamped in the grinding holder between the tool holder and the machine forming a flexible coupling therebetween. The web is reinforced to withstand the forces as all the forces generated during the machining are transferred and absorbed through the web to and from the tool holder and the machine. This prior art grinding holder uses the flexibility in the web to create a spring or damping action so that any unevenness in the surface that is machined is compensated for. This prior art grinding holder is shown in an exploded view in FIG. 4 and an assembled view in FIG. 5. Here, E comprises two or three Polycords, i.e. the reinforced web. E is clamped between plate F and the upper plate B and between the ring C and the plate I by screws, wherein a puck-like plate member H made of silicone is put between F and I. This arrangement means that the web is the essential part holding together all the other parts of the prior art grinding holder.

A disadvantage of the known grinding holders for tool holders in machines for machining surfaces, e.g. floor surfaces, is that the flexible cord is hardened or stiffened and compressed over time and wears, whereby the flexibility in the grinding holder between the machine and the tool deteriorates over time and worsens the machining and the resulting planes and flatness. The prior art grinding holders therefore have a disadvantage in that the machining and its result is difficult to foresee and control making the final resulting surface quality low. This also means that the grinding holders have to be replaced, i.e. the flexible cord has to be replaced more often than desired to keep track of the flexibility during machining. The flexible cords also have to be manufactured with a very high strength as all forces from the tool is transferred or absorbed via the cord making the performance of the cord more stiff than soft. These prior art cords may also have varying flexibility in different directions making the machining and the wear of the tool more difficult to control. Moreover, these prior art grinding holders must be designed to endure forces with different directions, i.e. both torsional and linear forces, meaning that it has to be manufactured in a specific way material.

Furthermore, as the cord/web holds the grinding holder together, this means that if the cord is broken or split the components forming the grinding holder may come loose/off increasing the risk of damaging surrounding parts of the machining device and the personnel handling it as the components rotate and may fly apart. The prior art grinding holders are also sensitive for sudden impacts, e.g. collisions with hard portions of the surface or edges or jamming of the tool in the surface, in that the cord may be drawn skew or uneven, which creates an imbalance in the tool and the machine that may cause undesired chucks/flings in the components, such that a undesired bevelled/oblique/skew grinding is performed resulting in a faulty wear of the tool, i.e. its machining elements, that may create undesired scratches in the machined surface.

SUMMARY

An object of the invention is therefore to provide an improved grinding holder, which eliminates or at least reduces the disadvantages for prior art grinding holders.

The invention is defined by the enclosed independent claim. Embodiments are set forth by the dependent claims attached and by the following description and the drawings.

According to the invention a grinding holder for connecting a rotary driven tool to a device for machining floor and road surfaces, comprises a first plate member for detachable attachment of the tool, and a second plate member for detachable attachment to the machining device. The plate members are movably and detachably interconnected by means of an universal joint, such that the tool is adaptable to any unevenness in the floor and road surfaces when machining the floor, and the plate members are flexibly interconnected by means of at least one elastic element.

The plate members may be interconnected by the universal joint comprising a common intermediate plate coupling.

The plate members may be rotatably interconnected via rotary bearings detachably mounted to the plate members and the intermediate plate coupling.

Each plate member may be mounted to the intermediate plate coupling via a pair of rotary bearings having their rotary axis in alignment. The rotary axis of one pair of rotary bearings may be arranged perpendicularly to the rotary axis of the other pair of rotary bearings. The rotary axis of each pair of rotary bearings may be arranged in parallel with the associated plate member.

Moreover, each pair of rotary bearings may comprise a pair of bearing houses detachably attached to the associated plate member, and faces the other pair of bearing houses and protrudes above its associated plate member towards the other plate member.

Furthermore, each elastic element may be arranged at the periphery of each of the plate members. Alternatively, each elastic element may be arranged around the periphery of each of the plate members. Moreover, each elastic element may be arranged evenly distributed along the periphery of each of the plate members. Each elastic element may extend in a direction being perpendicular to the rotary axes of the rotary bearings. Alternatively, each elastic element may be placed between the two plate members. Alternatively, each elastic element may be detachably attached at one end to the first plate member and detachably attached at the other end to the second plate member. Alternatively, each of the ends of each elastic element may have plane surfaces being parallel for bearing against the plate members.

Each plate member may have recesses aligned with the pair of bearing houses on the opposite plate member such that an additional range of movement is provided for each plate member by means of the recesses being adapted to eliminate the risk of collision between the pair of bearing houses following the movement of the associated plate member and the other plate member.

The first plate member may have a circular shape. Alternatively, the second plate member may have a substantially square shape. Alternatively, the second plate member may have an H-shape, whereby the recesses form cut-in portions of the H-shape.

The common intermediate plate coupling may have a cross-shape; the two plate members comprises means for adjusting the position of the at least one elastic element in relation to the plate members such that the unevenness adaptability of the tool is variable; and the means for adjusting the position of the at least one elastic element in relation to the plate members are in the form of detachable fastening points at different distances from the peripheries of the plate members.

Each elastic element may have any shape. Each elastic element may have a symmetrical shape, a non-symmetrical shape, a circular shape, a curved shape, a cylindrical shape, a shape with corners, a square shape, a triangular shape, an octagonal shape, or staff-shape. Each elastic element may have any cross-section. Each elastic element may have a square, triangular or octagonal cross-section. Each elastic element may be manufactured by rubber, plastic, silicone or other resilient material or be manufactured by any combination of these materials.

The invention also concerns a machine for machining floors, comprising at least one grinding holder in accordance with any of the embodiments defined above.

Providing a machine for machining floor or road surfaces with a grinding holder according to the invention for a tool holder and a tool used in the machine, which grinding holder has an adjustable adaptability for the tool makes the tool more easily controlled during machining and provides the tool with a more exact performance when machining. This also means that the suspension of the tool holder and the tool and associated components may be optimized compared to prior art grinding holders, and that the grinding holder according to the invention enables an adjustability in that it may be equipped with any suitable flexibility/dampening, i.e. any suitable stiffening or softening of the tools adaptability, by only replacing the present at least one flexible/elastic element with another element having other properties, shape or size without requiring a full disassemble of the grinding holder as in prior art grinding holders. This also enables an adaptation of the stiffness and/or softness of the grinding holder to any suitable tool and/or the type of machining, i.e. a harder/tougher machining or tool require a "stiffer" grinding holder while a not as tough/rough machining or tool require a grinding holder with a "softer" performance. The inventive grinding holder makes the tool and the machine using the tool easier to handle and maintain reducing, consequently, costs associated therewith. Moreover, the grinding holder according to the invention has a higher strength compared to prior art and is therefore less sensitive for impacts, collisions and jamming of the tool into the surface, i.e. the inventive grinding holder is more durable than prior art grinding holders.

BRIEF DESCRIPTION OF THE DRAWINGS

The tool holder will now be described in more detail with reference to the drawings enclosed, in which.

DETAILED DESCRIPTION OF EMBODIMENTS

Figure 1:
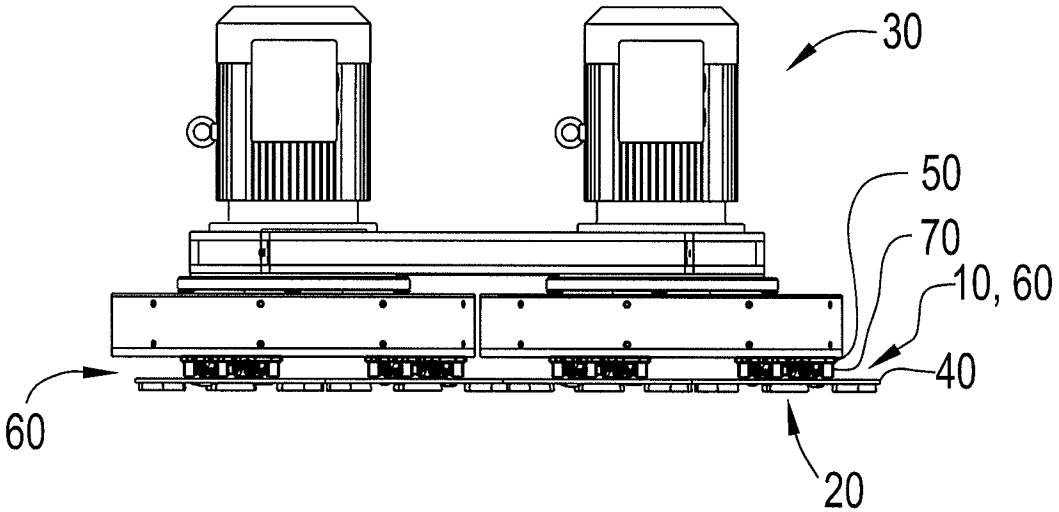
FIG. 1 is a front view of a part of an exemplary machine with a grinding holder according to the invention.

FIG. 1 indicates a machine 30 for machining surfaces on floors or roads, preferably having concrete or stone as a wearing layer, with at least one abrading, machining or grinding tool 20, each tool may be detachably mounted on a tool holder (not shown) that in turn is detachably mounted onto a grinding holder 10 according to the invention or each tool may be directly mounted onto the inventive grinding holder as shown in FIG. 1. The tool 20 may comprise at least one rotating plate adapted for machining of surfaces by means of at least one surface contacting machining disc (not shown) with machining bits, which is driven by a power source, e.g. motors as indicated in FIG. 1, as is explained in more detail in for example the patent publication WO 94/08752. In this document, the grinding machine comprises two motors, each motor separately rotating one or more tools via a belt transmission. The driving of the tools may also be performed by direct drive. Moreover, the invention does not relate directly to the tool 20 meaning that any tool suitable for this type of machining may be used together with the invention.

The floor surfaces may be stone, concrete, different types of asphalt, or different types of coatings on these surfaces, e.g. epoxy lacquers/resins/adhesives, plastic materials (e.g. plastic mats), paint, lacquer, or any other type of floors and coatings. Moreover, the grinding holder 10 may also be used for tools 20 cleaning and polishing floor surfaces by using cleaning and/or polishing pads instead of machining elements, e.g. TWISTER®-pads. On the tools a suitable number of machining, i.e. grinding discs may be attached, which discs are provided with detachably attached machining elements, which elements are positioned according to a predetermined and known pattern, i.e. a pattern suitable for the desired machining, at the periphery of each disc. Each machining disc is rotated substantially in a plane parallel to the surface to be machined and the planes of the tools in a known way and by means of known driver means as explained earlier. There may be one or more than one disc, e.g. two, three or four or more, per carrier plate forming the tool 20 and these discs may be rotated in desired ways. Each carrier plate (not shown) supports a number of machining discs, which may be of any kind, e.g. as disclosed in EP-1 321 233 and/or WO 2004/108352.

The grinding holder 10 according to the invention comprises two rotatable plate members, a first plate member 40 and a second plate member 50, which are driven during use and arranged adjacent each other in alignment and arranged in parallel and at a distance from each other. The plate members 40, 50 are movably and detachably interconnected by means of a universal joint 60, such that the tool 20 is adaptable to any unevenness in the floor and road surfaces, i.e. the tool is tiltable in relation to the floor and road surface plane, when machining the floor. The parallelism of the two plate members is a fact when the tool 20 is not in use and the plate members are kept still in their assembled state, but, when the tool holder 10 is in use during machining, the first plate member 40 may be moved/tilted relative to the second plate member 50 and also in relation to and in response to any unevenness on the machined surface. The tool is detachably mounted to the first plate member 40 and the second plate member 50 is detachably mounted to the machining device 30. This arrangement means that the first plate member 40 is movable separately in relation to the second plate member 50 and the machine 30 while the second plate member is only movable, i.e. rotatable in relation to the machine, i.e. the second plate member 50 is not tiltable in relation to the machine, and instead it follows the movements of the machine.

The plate members 40, 50 have their axes around which they rotate aligned with shafts (not shown). In the shown embodiment of FIGS. 2 and 3, the plates have their axes aligned vertically, i.e. their centre holes are aligned in a known way.

The plates 40, 50 may be detachably attached to each other, the tool 20 and the machining device 30 by fastening means in the form of screws, but could of course also be attached to the tool and/or the machining device by means of a key joint, a splined coupling, force or shrinkage fit so that a rotation of one plate member 40, 50 also rotates the other fitted component, i.e. the other plate member 40, 50 and/or the tool 20 during machining.

The grinding holder 10 has the function of an adaptor or coupling for creating a flexible connection of the tool 20 to the machining device 30 by means of the universal joint 60. The plate members 40, 50 may be flexibly interconnected by means of at least one elastic element 70. This element is flexible and detachably mounted in the grinding holder so that it may be replaced easily when broken or easily replaced by another element 70 that is stiffer or softer than the earlier one, whereby the flexibility, i.e. the adaptability of the grinding holder 10 may be varied to allow more or less damping of movements and forces in the tool 20. The at least one elastic element 70 is arranged in the grinding holder 10 such that is urges, i.e. strives to keep the plate members 40, 50 in parallel to each other, whereby the grinding holder 10 is provided with a restoring function, i.e. if the tool 20 tilts (due to any unevenness in the surface being machined) moving the first plate member 40 in relation to the second plate member 50, the elastic element press and pulls to return the first plate member to its earlier parallel state, whereby the unevenness is machined by pressing the tool 20 harder against it.

Figure 2:
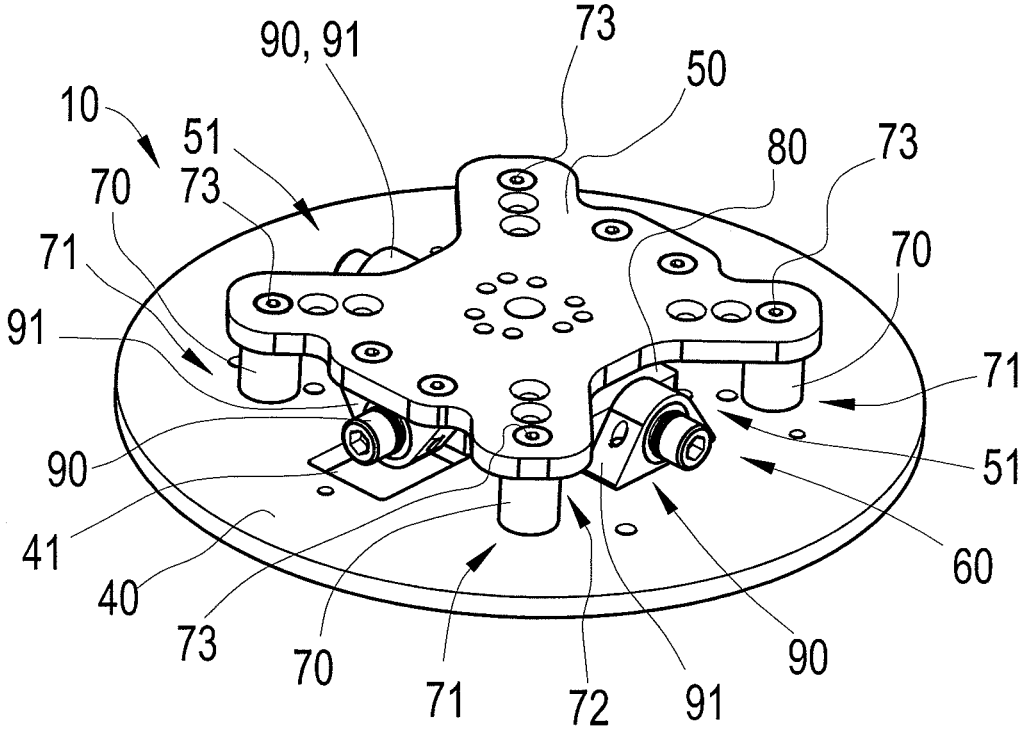
FIG. 2 is a perspective view of one grinding holder in FIG. 1.
Figure 3:
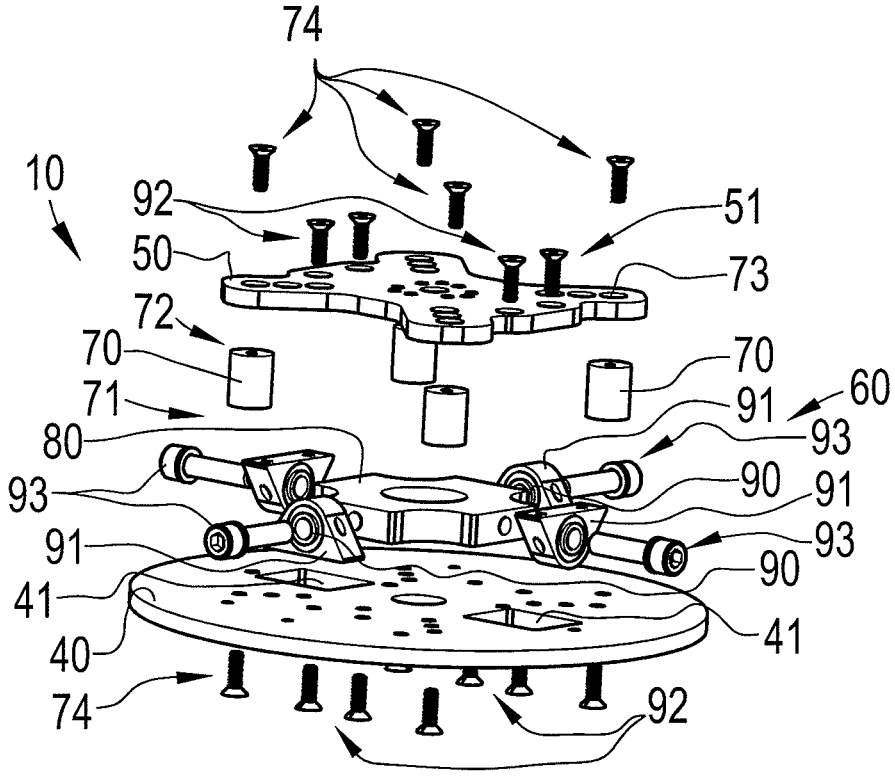
FIG. 3 is an exploded perspective view of the grinding holder in FIG. 2.
Figure 4:
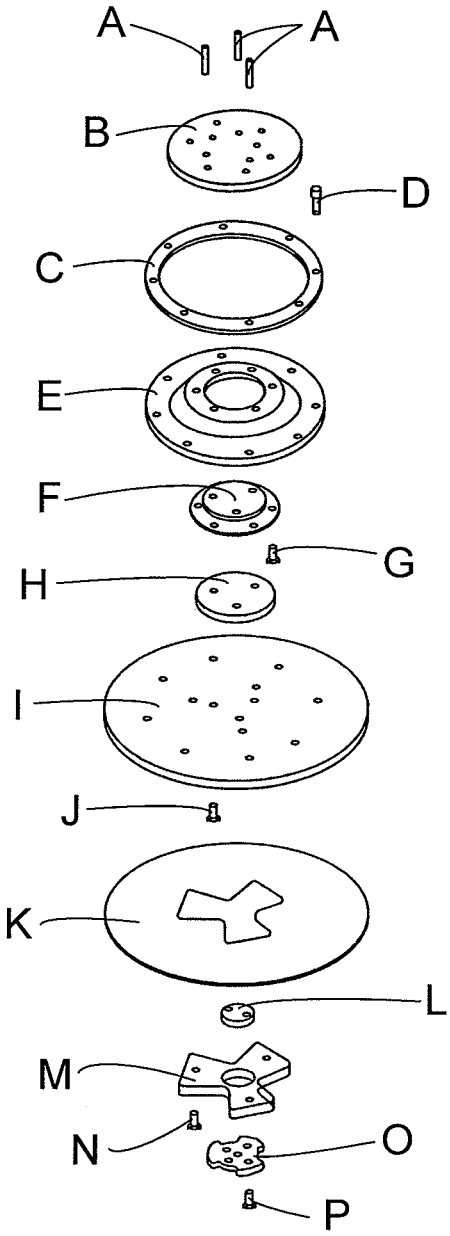
FIG. 4 is an exploded perspective view of a prior art grinding holder.
Figure 5:
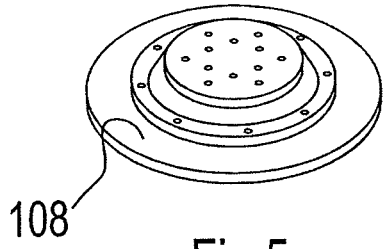
FIG. 5 is a perspective view of the assembled grinding holder in FIG. 4.

The plate members 40, 50 may be interconnected by the universal joint 60 comprising a common intermediate plate coupling 80 as shown in FIGS. 2 and 3. The plate coupling works both as a distance piece and intermediate coupling placed between the two plate members and is movably mounted thereto.

The plate members 40, 50 may be rotatably interconnected via rotary bearings 90 detachably mounted to the intermediate plate coupling 80 as shown in FIG. 2. This allows the plate members to rotate in relation to each other and the plate coupling providing the tool holder 10, i.e. the tool 20, with a range of movement such that it follows, i.e. compensates for any unevenness in the surface being machined. Each plate member 40, 50 may be detachably mounted to the intermediate plate coupling 80 via a pair of rotary bearings 90 having their rotary axis in alignment. The rotary bearings have their rotary axes in parallel with the planes of the plate members.

The rotary axis of one pair of rotary bearings 90 is arranged perpendicularly to the rotary axis of the other pair of rotary bearings in one embodiment meaning that the plate members 40, 50 allow for the tool 20 to compensate for any unevenness in a sufficient number of directions. As explained earlier, the grinding holder 10 strives to keep the two plate members in parallel with each other, such that the surface being machined becomes as plane/flat as possible. In another embodiment, the rotary axis of each pair of rotary bearings 90 is arranged in parallel with the associated plate member 40, 50. This arrangement provides an exact and controlled guiding of the movement for each plate member enhancing the machining result. In yet another embodiment, each pair of rotary bearings 90 comprises a pair of bearing houses 91 detachably attached to the associated plate member, which bearing houses face each other in pairs and protrude above its associated plate member towards the other plate member, and provide a high stability for the interconnection of the plate members and consequently the tool holder 20. In one embodiment, the bases of the rotary bearings 90 in one pair of rotary bearings face in the opposite direction compared to each rotary bearing in the other pair, i.e. the rotary bearings are turned upside down compared to the other rotary bearings, as seen in FIGS. 2-3.

Each elastic element 70 may be arranged at the periphery of each of the two plate members 40, 50. This arrangement provides a good force and moment relationship between the tool 20, the plate members, the machining device 30 and each elastic element in regard of force and moment loads during machining. In other embodiments, each elastic element 70 is arranged around the periphery of each of the two plate members 40, 50 or each elastic element is arranged evenly distributed along the periphery of each of the two plate members.

Each elastic element 70 in one embodiment extends in a direction being perpendicular to the rotary axes of the rotary bearings 90 between the two plate members 40, 50. Each element may extend in a direction being perpendicular to the two plate members. Each elastic element 70 may be placed between the two plate members, and, each elastic element may be detachably attached at one end 71 to the first plate member 40 and detachably attached at the other end 72 to the second plate member 50. Moreover, each of the ends 71, 72 of each elastic element may be plane surfaces for bearing against the plate members. Each elastic element may have any shape between its ends, each elastic element may have any cross-section, each elastic element may have a rounded shape between the ends, or each elastic element may have a cylindrical shape. This means that the element 70 may have a square or triangular shape and/or cross-section, the element may have a collar or ring-shape or be a curved element having cross-section of a portion of a circle or be a straight elongated element, e.g. a staff-shape. Moreover, the elastic element 70 may be made of a flexible material, an elastic material, rubber, silicone, plastic, or be a medium-filled container that when pressed gives a resilient effect, or any other suitable material, or be made of a combination of different materials, e.g. a rubber cylinder, as shown in FIG. 3, with threaded plates vulcanized at each of its ends 71, 72 for detachable mounting to the associated plate member 40, 50. In FIG. 2, the elements 70 are arranged at the corners of the second plate member 50 in the square-shaped embodiment.

The stiffness/softness of the element 70 may be optionally varied by using differently sized elements with different shapes and cross-sections, and any combinations of these parameters.

Each plate member 40, 50 may have recesses 41, 51 aligned with the pair of bearing houses 91 on the opposite plate member such that an additional range of movement is provided for each plate member by means of the recesses being adapted to eliminate the risk of collision between the pair of bearing houses following the movement of the associated plate member and the other plate member. This arrangement ensures that there is no risk of collision between the plate members and their bearing houses when the tool 20 moves the first plate member 40 in relation to the second plate member 50 and in response to the structure of the surface being machined.

The tool holder 10 may comprise the first plate member 40 having a circular shape, and, the second plate member 50 may have a substantially square shape, i.e. the second plate member in yet another embodiment has an H-shape, whereby its recesses 51 form cut-in portions of the H-shape.

The common intermediate plate coupling 80 may have a cross-shape. The intermediate plate coupling may have a square shape, may be octagonal and may be circular, but, preferably, it has at least four plane surfaces for a sufficient bearing against the plane surfaces of each rotary bearing 90 facing the plate coupling 80.

The two plate members 40, 50 may comprises means for adjusting the position of the at least one elastic element 70 in relation to the plate members such that the unevenness adaptability of the tool 20 is variable. This arrangement is shown in FIGS. 2 and 3. Means for adjusting the position of the at least one elastic element 70 in relation to the plate members may be in the form of detachable fastening points 73 being arranged at different distances from the peripheries of the plate members 40, 50. Moreover, the elastic element 70 may be detachably and slidably mounted in a corresponding slot on the associated plate member in which slot the element is removably clamped such that the element is easily loosened, slid into a new position and clamped securely against the plate member. These arrangements means that the closer the element is placed the edge of the associated plate member 40, 50 the larger force/moment is required for pressing or pulling the element, i.e. to deform it.

The rotary axes of the rotary bearings 90 may be arranged in parallel and in the same plane as the intermediate plate coupling 80 but could also be arranged in parallel but in another plane than the plate coupling.

The universal joint 60 comprises the intermediate plate coupling 80, the rotary bearings 90, the bearing houses 91, screws 92 for detachably mounting each bearing house 91 to the associated plate member 40, 50, and screws 93 for detachably, rotatably and steady mount the plate coupling to the associated bearing houses.

Each of the three plates 40, 50, 80 in the grinding holder 10 according to the invention has a centre hole aligned with the centre holes of the other plates, which hole is adapted for fitting against a motor shaft, such that the tool 20 may be rotated during machining.

The invention claimed is:

1. A grinding holder for connecting a rotary driven tool to a device for machining floor and road surfaces, comprising a first plate member for detachable attachment of the tool, and a second plate member for detachable attachment to the machining device, the plate members are flexibly interconnected by means of at least one elastic element, and the plate members are movably and detachably interconnected by means of an universal joint, comprising a common intermediate plate coupling, such that the tool is adaptable to any unevenness in the floor and road surfaces when machining the floor, wherein the plate members are rotatably interconnected via rotary bearings detachably mounted to one of the plate members and to the intermediate plate coupling.

2. A grinding holder according to claim 1, wherein each plate member is mounted to the intermediate plate coupling via a pair of rotary bearings having their rotary axis in alignment.

3. A grinding holder according to claim 2, wherein the rotary axis of one pair of rotary bearings is arranged perpendicularly to the rotary axis of the other pair of rotary bearings.

4. A grinding holder according to claim 2, wherein the rotary axis of each pair of rotary bearings is arranged in parallel with the associated plate member.

5. A grinding holder according to claim 1, wherein each pair of rotary bearings comprises a pair of bearing houses detachably attached to the associated plate member, and faces the other pair of bearing houses and protrudes above its associated plate member towards the other plate member.

6. A grinding holder according to claim 1, wherein each elastic element is arranged at the periphery of each of the plate members.

7. A grinding holder according to claim 1, wherein each elastic element is arranged around the periphery of each of the plate members.

8. A grinding holder according to claim 1, wherein each elastic element is arranged evenly distributed along the periphery of each of the plate members.

9. A grinding holder according to claim 2, wherein each elastic element extends in a direction being perpendicular to the rotary axes of the rotary bearings.

10. A grinding holder according to claim 1, wherein each elastic element is placed between the two plate members.

11. A grinding holder according to claim 1, wherein each elastic element is detachably attached at one end to the first plate member and detachably attached at the other end to the second plate member.

12. A grinding holder according to claim 11, wherein each of the ends of each elastic element has plane surfaces being parallel for bearing against the plate members.

13. A grinding holder according to claim 5, wherein each plate member has recesses aligned with the pair of bearing houses on the opposite plate member such that an additional range of movement is provided for each plate member by means of the recesses being adapted to eliminate the risk of collision between the pair of bearing houses following the movement of the associated plate member and the other plate member.

14. A grinding holder according to claim 1, wherein the first plate member has a circular shape.

15. A grinding holder according to claim 1, wherein the second plate member has a substantially square shape.

16. A grinding holder according to claim 15, wherein the second plate member has an H-shape, whereby the recesses form cut-in portions of the H-shape.

17. A grinding holder according to claim 1, wherein the common intermediate plate coupling has a cross-shape.

18. A grinding holder according to claim 1 wherein the two plate members comprises means for adjusting the position of the at least one elastic element in relation to the plate members such that the unevenness adaptability of the tool is variable.

19. A grinding holder according to claims 18, wherein the means for adjusting the position of the at least one elastic element in relation to the plate members are in the form of detachable fastening points at different distances from the peripheries of the plate members.

20. A grinding holder according to claim 1, wherein each elastic element has a symmetrical shape.

21. A grinding holder according to claim 1, wherein each elastic element has a non-symmetrical shape.

22. A grinding holder according to claim 1, wherein each elastic element has a circular, curved or cylindrical shape.

23. A grinding holder according to claim 1, wherein each elastic element has a shape with corners.

24. A grinding holder according to claim 23, wherein each elastic element has a square, triangular, octagonal, or staff-shape.

25. A grinding holder according to claim 23, wherein each elastic element has a square, triangular or octagonal cross-section.

26. A grinding holder according to claim 1, wherein each elastic element may be manufactured by rubber, plastic, silicone or other resilient material or be manufactured by any combination of these materials.

27. A machine for machining floors, wherein the machine comprises at least one grinding holder in accordance with claim 1.

* * * * *

UNITED STATES PATENT AND TRADEMARK OFFICE

CERTIFICATE OF CORRECTION

PATENT NO. : 8,475,235 B2
APPLICATION NO. : 12/596628
DATED : July 2, 2013
INVENTOR(S) : Kilgren et al.

It is certified that error appears in the above-identified patent and that said Letters Patent is hereby corrected as shown below:

In the Specification

Col. 7, line 30: "may comprises means for" should read --may comprise means for--

Signed and Sealed this
Twenty-ninth Day of April, 2014

Michelle K. Lee

Michelle K. Lee
*Deputy Director of the United States Patent and Trademark Office*